United States Patent [19]

Bernard et al.

[11] Patent Number: 4,737,607

[45] Date of Patent: Apr. 12, 1988

[54] ELECTRICAL CIRCUIT BREAKER WITH SELF-EXPANSION AND ROTATING ARC

[75] Inventors: Georges Bernard, Saint-Egreve; Pierre Leclercq, Moirans; Serge Olive, St. Paul-De-Varces, all of France

[73] Assignee: Merlin Gerin, Grenoble Cedex, France

[21] Appl. No.: 27,322

[22] Filed: Mar. 18, 1987

[30] Foreign Application Priority Data

Mar. 28, 1986 [FR] France ..... 86 04742

[51] Int. Cl.[4] ..... H01H 33/18

[52] U.S. Cl. ..... 200/147 R; 200/146 R; 200/148 B

[58] Field of Search ..... 200/147 R, 146 R, 148 B

[56] References Cited

U.S. PATENT DOCUMENTS

| | | | |
|---|---|---|---|
| 4,153,827 | 5/1979 | Mircovich et al. | 200/147 R |
| 4,249,052 | 2/1981 | Votta et al. | 200/146 R |
| 4,329,551 | 5/1982 | Bernard et al. | 200/147 R |
| 4,427,859 | 1/1984 | Cancio | 200/147 R |
| 4,463,230 | 7/1984 | Perrenoud | 200/147 R |

FOREIGN PATENT DOCUMENTS

| | | |
|---|---|---|
| 0004213 | 9/1979 | European Pat. Off. . |
| 0021951 | 1/1981 | European Pat. Off. . |
| 2479553 | 10/1981 | France . |
| 1321812 | 7/1973 | United Kingdom . |

*Primary Examiner*—Robert S. Macon
*Attorney, Agent, or Firm*—Parkhurst & Oliff

[57] ABSTRACT

An electrical circuit breaker with self-expansion and rotating arc insulated with SF6 comprises a fixed arcing contact secured to the front face of a magnetic blow-out coil.

An electrode is electrically insulated from the fixed arcing contact and covers the front face being connected to the opposite end of the coil by a branch circuit. The electrode is arranged to pick up a fraction of the arcing current, so that the magnetic field generated in the breaking zone by the coil remains appreciably constant when the value of the short-circuit current exceeds a predetermined threshold.

9 Claims, 3 Drawing Sheets

ELECTRICAL CIRCUIT BREAKER WITH SELF-EXPANSION AND ROTATING ARC

BACKGROUND OF THE INVENTION

The invention relates to an electrical circuit breaker with self-expansion and rotating arc, housed in a sealed casing filled with an insulating gas with high dielectric strength, notably sulphur hexafluoride, and comprising an arc extinction device arranged in a first extinguishing chamber, capable of communicating by means of exhaust channels with a second adjacent expansion chamber, said arc extinction device of each pole comprising :

a system of separable contacts having a movable arcing contact part mounted with sliding in the first chamber and capable of cooperating in the closed position with a fixed or semi-fixed arcing contact part, a magnetic blow-out coil arranged in the first chamber to generate a magnetic field in the breaking zone, causing rotation of the arc when the arcing contact parts separate, communication ducts inside the hollow arcing contact parts to constitute said exhaust channels for the compressed gas from the first chamber to flow to the second expansion chamber, and an electrode to pick up the electrical arc in the breaking zone.

In a state of the art circuit breaker of the kind mentioned, the arc pick-up electrode is adjoining the front face of the coil, and the tubular fixed or semi-fixed arcing contact is set back from the electrode inside the coil. Switching of the arc onto the electrode causes the blow-out coil to be energized after the contacts have separated. The arc centering effect due to the action of the field is accentuated by the air blow-out during the phase in which the gases escape through the communication ducts between the extinguishing chamber and the expansion chamber. This results in a possibility of the arc root anchored on the electrode restriking on the fixed arcing contact, causing almost total shunting of the coil. The decrease of the magnetic field in the arcing zone causes the rotation of the arc roots to stop. Extinction of the arc is then jeopardized.

The coil generally has the total arcing current flowing through it when a short-circuit occurs causing a strong magnetic field in the breaking zone. Too fast rotation of the arc due to the action of this field may impede cooling of the arc.

The object of the invention consists of achieving a circuit breaker with self-expansion and rotating arc having a reliable arc extinction device, without the risk of the magnetic blow-out coil being de-energized.

SUMMARY OF THE INVENTION

The circuit breaker according to the invention is characterized by the fact that the fixed or semi-fixed arcing contact part is coaxially surrounded by the coil being electrically connected to one of its ends linked with the front face, and that the electrode is electrically insulated from the fixed arcing contact and from said front face by a gap and is connected to the opposite end of the coil by a branch circuit, located in the extinguishing chamber, outside the coil, said electrode being arranged to pick up a fraction of the arcing current, in such a way that the electrical field generated by the coil in the breaking zone remains appreciably constant, when the value of the short-circuit current exceeds a predetermined threshold.

The electrode covers the front face of the coil, with said insulating gap arranged in between, and presents an annular arc pick-up edge, allowing the movable arcing contact part to pass axially to the closed position, the fixed arcing contact part being slightly set back in relation to said edge of the electrode.

When the arcing current is not very high, the arc remains anchored between the fixed and movable arcing contact parts, and moves in rotation due to the action of the magnetic field created by the permanent energization of the coil. The arc does not migrate onto the electrode, causing an absence of current in the branch circuit. Exceeding the predetermined threshold, in the case of a large short-circuit occurring, causes an automatic distribution of the current in the coil and the branch circuit. The current energizing the coil is limited to a certain value allowing the maximum amplitude of the magnetic field in the arcing zone to be adjusted. The excess current is shunted by the branch circuit.

The annular edge of the electrode is advantageously equipped with a metal revolution extension, notably cylindrical or curved, extending out from the fixed arcing contact part in the direction of the first support tube of the movable arcing contact part.

The electrode can also play the role of cooling element taking part in deionization of the arc in the breaking zone.

BRIEF DESCRIPTION OF THE DRAWINGS

Other advantages and characteristics will become more clearly apparent from the following description of an embodiment of the invention, given as a non-limiting example only, and represented in the accompanying drawings, in which.

DESCRIPTION OF THE PREFERRED EMBODIMENT

Figure 1:
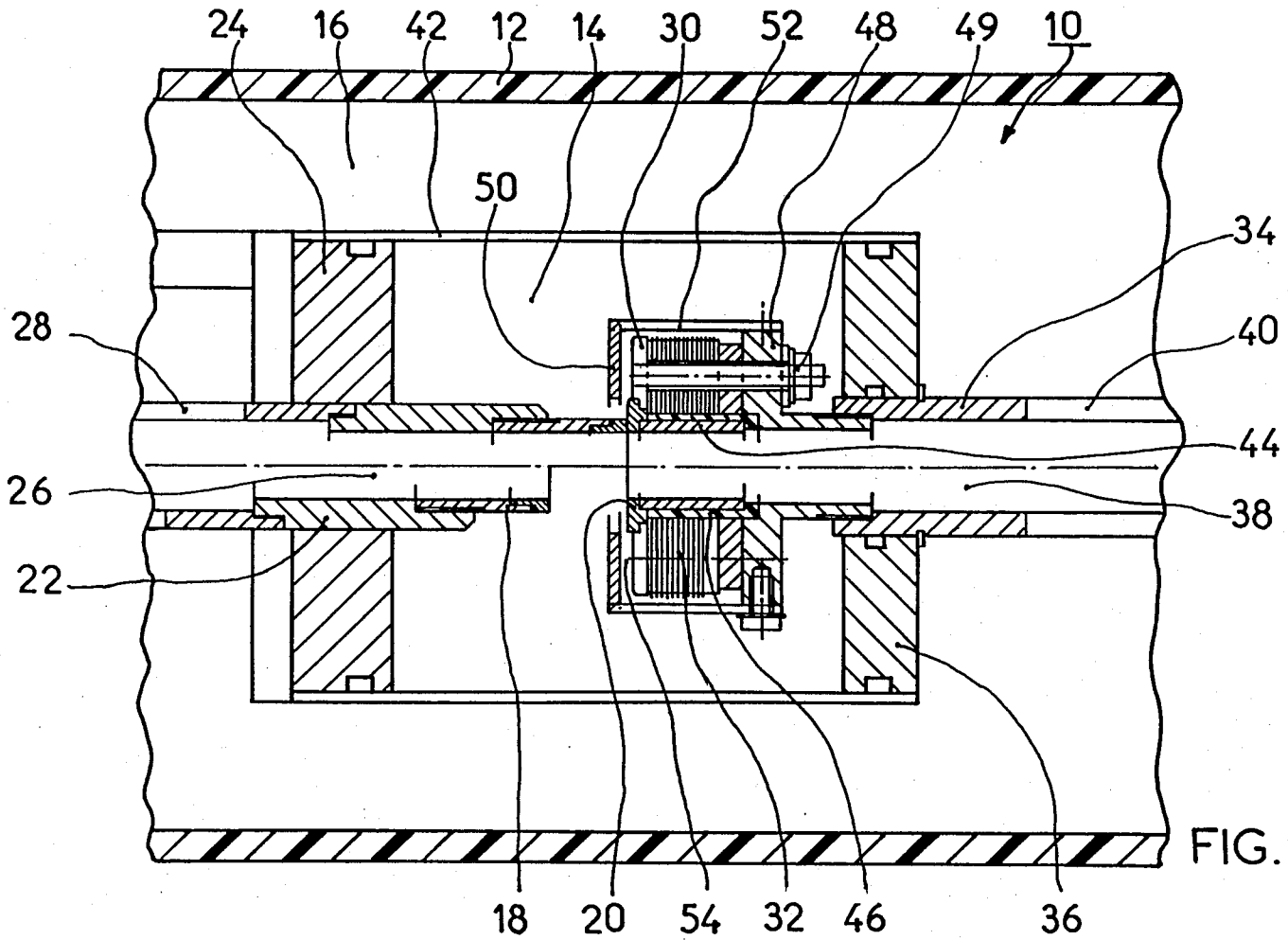
FIG. 1 is an elevational axial section view of a part of a self-expansion circuit breaker pole according to the invention, represented in the upper half-view in the closed position, and in the lower half-view in the open position.
Figure 2:
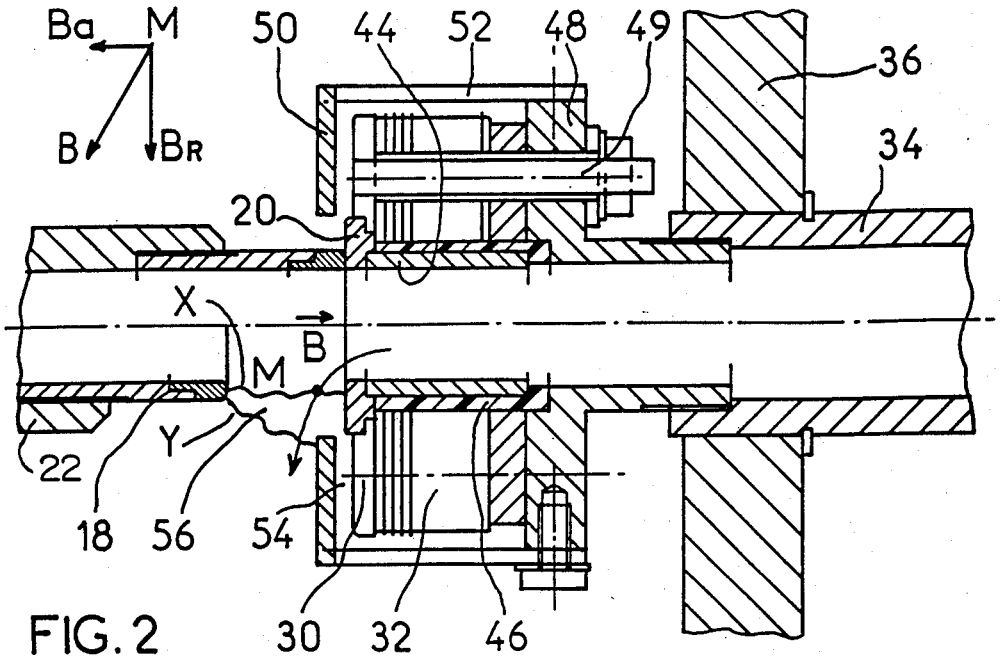
FIG. 2 is a partial view on an enlarged scale of FIG. 1, showing the arrangement of the arc extinction device.

In FIGS. 1 and 2, an electrical circuit breaker pole comprises a self-blowout arc extinction device 10 by thermal expansion and rotating arc. The pole is housed in a sealed cylindrical casing 12, filled with electronegative insulating gas with a high dielectric strength, notably sulphur hexafluoride SF6, at a suitable pressure. The casing 12 of insulating material is internallly subdivided into a first extinguishing chamber 14 containing the arc extinction device 10, and at least a second expansion chamber 16 allowing the breaking gases coming from the first extinguishing chamber 14 to escape. The circuit breaker comprises a pair of hollow separable arcing contacts 18, 20, arranged inside the first extinguishing chamber 14 in alignment with the axial direction of the casing 12. The main contact system for the rated current to be conducted in the absence of a fault is not represented in the figures.

The movable arcing contact 18 is supported by a first support tube 22 made of conducting material passing with axial sliding through a cylindrical radial wall 24 of the arc chute 14. The tube 22 is mechanically secured to an operating mechanism control rod (not shown), and is fitted with an axial duct 26 which communicates with the second expansion chamber 16 via orifices 28.

The fixed arcing contact 20 is formed by an annular conducting track having an internal diameter equal to that of the movable arcing contact 18 to enable the contacts 18, 20 to come into abutment in the closed position. The fixed arcing contact track 20 constitutes a short-circuit ring fixed by welding to the front face 30 of an electromagnetic coil 32 which causes rotation of the electrical arc drawn when the arcing contacts 18, 20 separate. The cylindrical coil 32 is fixed and is located in the first extinguishing chamber 14 being supported by a second fixed support tube 34 of conducting material, which passes through a wall 36 of the extinguishing chamber 14 opposite the other wall 24. An axial duct 38 is arranged in the second support tube 34, and communicates with the expansion chamber 16 via orifices 40. A cylindrical partition 42 surrounds the two radial walls 24, 36 to delimit the first extinguishing chamber 14 of the pole. The partition 42 may be of any suitable shape, for example spherical or ellipsoidal. The fixed arcing contact 20 is adjoined on the one hand to a hollow internal bush 44 of ferromagnetic material, coaxially surrounded by the coil 32 with an insulating sheath 46 interposed. One of the ends of the coil 32 is electrically connected to the tail-part of the fixed arcing contact track 20, and the opposite end is connected to a conducting sleeve linked with the second support tube 34. Fixing bolts 49 secure the coil 32 mechanically to the sleeve 48.

An annular electrode 50 is connected to the sleeve 48 by a branch conductor 52 which externally surrounds the coil 32 inside the first extinguishing chamber 14. The electrode 50 is formed by a conducting ring extending radially along the front face 30 of the coil 32, and separated from the latter by an axial gap 54 of small thickness. The internal diameter of the annular electrode 50 is greater than the external diameter of the sliding arcing contact 18 to enable the latter to come into abutment with the fixed arcing contact 20 in the closed position. The fixed arcing contact 20 is slightly set back axially in relation to the free end of the electrode 50.

Operation of the arc extinction device 10 of the circuit breaker according to FIGS. 1 and 2 is as follows :

after opening of the main contacts (not shown) in the tripping phase of the circuit breaker, the fault current is switched onto the arcing contacts 18, 20 circuit after passing through the coil 32. The separation of the arcing contacts 18, 20 causes an arc X in the breaking zone 56, located appreciably in the centre of the first extinguishing chamber 14. The magnetic field B, created by the coil 32 in the breaking zone 56, causes high-speed rotation of the arc X onto the annular track of the fixed arcing contact 20. The heating of the SF6 gas by the rotating arc brings about a pressure increase inside the first extinguishing chamber 14, and an axial flow of the compressed gas in the opposite direction through the exhaust ducts 26, 38 in the direction of the second expansion chamber 16. The rotating movement of the arc X, combined with the reverse double gas blowing ensure that the arc is rapidly extinguished after a set travel of the movable arcing contact 18 inside the first extinguishing chamber 14.

In FIG. 2, it can be seen that the rotation of the arc X in the breaking zone 56 is due to the action of the radial component BR of the magnetic field B (see diagram at point M). The axial component Ba of the magnetic field B tends to keep the arc X in proximity to the centre to reinforce anchoring of the arc roots on the fixed 20 and movable 18 arcing contacts. This centering effect of the arc X is accentuated by the centripetal gas blowing, in the self-expansion phase, causing a reverse double flow of the gases through the exhaust ducts 26, 38. The combined action of the magnetic field B and the gas blowing on the arc ensures continuous energization of the coil 32.

For very high short-circuit currents, a fraction Y of the arc is picked up by the electrode 50, in such a way as to cause a distribution of the arcing current through the coil 32 and the external branch circuit 52. Energization of the coil 32 is not interrupted during the breaking phase and results from the fraction X of the arcing current which is in parallel on the fraction Y. The intensity of the magnetic field B in the breaking zone 56 is thereby limited to a predetermined threshold, independently from the short-circuit current value. The threshold at which the arc will migrate onto the electrode 50 of the branch circuit 52 depends on the thickness of the axial gap 54, on the shape and spatial position of the electrode 50 in the first extinguishing chamber 14, and also on the electrical resistivity of the conducting material making up the branch circuit 52. The additional fraction Y of the arcing current flows through the branch circuit 52 to shunt the coil 32. The partial arc Y also moves in rotation due to the action of the field B and disappears as soon as the arcing current intensity drops below a predetermined value.

In addition to its function of magnetic field mondulator, the presence of the annular metallic electrode 50 in the extinguishing chamber 14 enables the arc roots to be cooled to further extinction of the arc. The electrode 50 is made of copper or copper alloy material.

The electrode 50 can also act as a dephasing ring between the magnetic field B, generated by the coil 32 and the arcing current, so as to improve the blow-out, notably when the current passes zero. It can thus be provided with a radial slot, if no phase displacement between magnetic field and current is desired.

Figure 3:
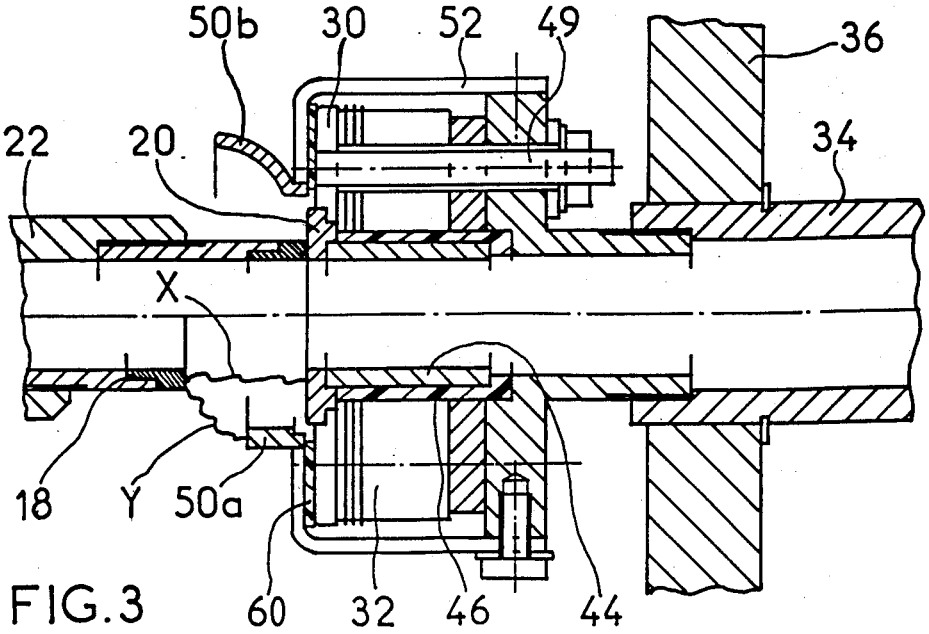
FIG. 3 is a variant of FIG. 2.

The striking electrode 50 can be of different shapes as represented in FIG. 3, notably a cylindrical axial bush (lower half-view) forming an extension of the radial conducting ring of the branch circuit 52, or a curved extension 50b of the conducting material extending out from the fixed arcing contact 20 (upper half-view).

According to an alternative embodiment (not shown), the movable arcing contact 18 in translation can also cooperate with a semi-fixed arcing contact 20 subjected to the action of a return spring, or with a fixed arcing contact 20 in the form of a tulip finger contact.

An intermediate disk 60 made of insulating material can be inserted in the axial gap 54 arranged between the electrode 50 and the front face 30 of the coil 32.

Figure 4:
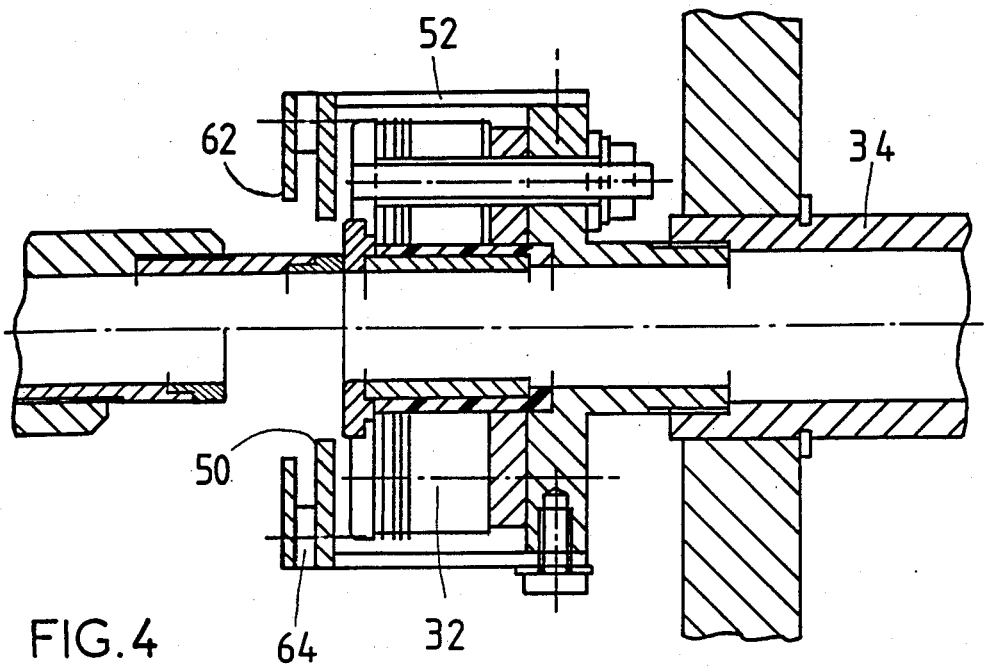
FIG. 4 is another variant of FIG. 2.

According to another alternative embodiment, represented in FIG. 4, a second annular electrode 62 can be associated with the electrode 50 of the branch circuit 52. An axial offset, determined by a spacer 64, separates the two coaxial electrodes 50, 62, and the second electrode 62 has an internal diameter greater than that of the first electrode 50.

We claim:

1. An electrical circuit breaker with self-expansion and rotating arc, housed in a sealed casing filled with an insulating gas with high dielectric strength, notably sulphur hexafluoride, and comprising an arc extinction device arranged in a first extinguishing chamber, capable of communicating by means of exhaust channels with a second adjacent expansion chamber, said arc extinction device of each pole comprising:

a system of separable contacts having a movable arcing contact part mounted with sliding in the first chamber and capable of cooperating in a closed position with a fixed or semi-fixed arcing contact part, a breaking zone provided between said fixed and movable arcing contact parts in an opened position, an arc being drawn in said breaking zone when the arcing contact parts separate, a magnetic blow-out coil arranged in the first chamber to generate a magnetic field causing rotation of the arc in the breaking zone, communication ducts inside the hollow arcing contact parts to constitute said exhaust channels for the compressed gas from the first chamber to flow to the second expansion chamber, an electrode to pick up the arc in the breaking zone, the coil surrounding coaxially said first arcing contact part, which is electrically connected with a first end of said coil, a front face of said coil being in contact with said first end, a gap designed to insulate the electrode from the fixed arcing contact and from said front face, and a branch circuit arranged in the first extinguishing chamber outside the coil, in such a way as to connect the electrode electrically to a second opposite end of the coil, said electrode being arranged to pick up a fraction of the arcing current so that the magnetic field generated by the coil in the breaking zone remains appreciably constant when the value of the short-circuit current exceeds a predetermined threshold.

2. An electrical circuit breaker according to claim 1, wherein the electrode covers the front face of the coil with said insulating gap arranged in between, and presents an annular arc pick-up edge, allowing the movable arcing contact part to pass axially to the closed position, the fixed arcing contact part being slightly set back in relation to said edge of the electrode.

3. An electrical circuit breaker according to claim 2, wherein the annular edge of the electrode is equipped with a metallic revolution extension, notably cylindrical or curved, extending out from the fixed arcing contact part in the direction of a first support tube of the movable arcing contact part.

4. An electrical circuit breaker according to claim 3, wherein the fixed arcing contact part is secured to the front face of the coil, and to a tubular internal bush of ferromagnetic material on which the coil is mounted with an insulating sheath interposed.

5. An electrical circuit breaker according to claim 4, wherein the coil and fixed arcing contact assembly is supported by a second support tube connected to a connection terminal of the pole, the branch circuit being connected opposite the electrode to a conducting sleeve, which is fitted between the opposite end of the coil and the second support tube disposed in axial alignment with the first movable arcing contact support tube.

6. An electrical circuit breaker according to claim 1, wherein an insulating disk is fitted in said axial gap arranged between the electrode and the front face.

7. An electrical circuit breaker according to claim 1, wherein the electrode has a metallic revolution surface designed to cool the arc roots in the breaking zone.

8. An electrical circuit breaker according to claim 1, wherein the electrode is provided with a radial slot.

9. An electrical circuit breaker according to claim 1, wherein the branch circuit is equipped with a second annular-shaped auxiliary electrode, axially separated from the main electrode by a spacer, the internal diameter of the second electrode being greater than that of the main electrode.

* * * * *